United States Patent [19]

Snyder

[11] 4,235,498

[45] Nov. 25, 1980

[54] ELECTRICAL CONNECTOR WITH LOCKING MEANS

[75] Inventor: Gene L. Snyder, Bainbridge, N.Y.

[73] Assignee: The Bendix Corporation, Southfield, Mich.

[21] Appl. No.: 60,717

[22] Filed: Jul. 26, 1979

[51] Int. Cl.[3] ..... H01R 4/54

[52] U.S. Cl. ..... 339/90 R; 339/DIG. 2

[58] Field of Search ..... 285/81, 82; 339/DIG. 2, 339/90

[56] References Cited

U.S. PATENT DOCUMENTS

| | | | |
|---|---|---|---|
| 1,871,421 | 8/1932 | Muhlhauser et al. | 285/82 |
| 3,455,580 | 7/1969 | Howard | 339/90 R |
| 3,594,700 | 7/1971 | Nava et al. | 339/DIG. 2 |
| 3,840,839 | 10/1974 | Smaczny et al. | 339/90 R |
| 3,917,373 | 11/1975 | Peterson | 285/82 |
| 3,947,081 | 3/1976 | Peterson | 339/90 R |

*Primary Examiner*—John McQuade

*Attorney, Agent, or Firm*—Paul J. Ethington; Raymond J. Eifler; C. Dennis Lacina

[57] ABSTRACT

An electrical connector is disclosed with a coupling nut (14) of the bayonet type for the connector bodies (10, 12) and an improved locking means (16) for the coupling nut. A resilient detent element (82) is disposed in a bayonet ramp groove (54) of the coupling nut (14) so as to be deflected and engaged by the corresponding bayonet pin (32) on one of the connector bodies when the coupling nut is tightened sufficiently to draw the connector bodies into abutting relationship.

6 Claims, 3 Drawing Figures

ELECTRICAL CONNECTOR WITH LOCKING MEANS

TECHNICAL FIELD

This invention relates to connectors and more particularly relates to separable electrical connectors of the type which are useful for connecting electrical cables.

BACKGROUND ART

Electrical connectors of the quick-disconnect or separable type are commonly used for connecting the wires of one cable to the corresponding wires of a similar cable. Typically, the connector comprises a plug member and a receptacle member with a set of pins serving as terminations for the wires of the cable on one member and a set of sockets for the pins serving as terminations for the wires of the cable on the other member. Connectors of this type must be not only easy to manipulate for quick connection and disconnection of the plug and receptacle members but also they must be extremely reliable in operation. Such connectors are typically provided with a coupling nut rotatably mounted on one of the members and adapted for threaded engagement with the other member whereby the plug and receptacle members may be drawn together by rotation of the coupling nut. to prevent unwanted separation of the connector members which might result from vibration or other extraneous causes, the coupling nut may be provided with locking means to hold it into position. In such connectors, it is desirable to maintain the connector members in close fitting engagement.

In the prior art, electrical connectors are known which utilize a coupling nut for drawing the connector members together with locking means for holding the coupling nut in place to prevent unwanted separation of the connector members. An exemplary device of this kind is disclosed in U.S. Pat. No. 2,984,811 granted to Hennessey, Jr., et al. and assigned to the same assignee as this application. In the connector shown in the Hennessey, Jr., et al. patent, a coupling nut on the first connector member is threadedly engaged with the second connector member by a bayonet coupling i.e. pin and groove type of threaded engagement. Locking means for the coupling nut comprises a resilient wave washer which operates in conjunction with a detent in the bayonet coupling. When the coupling nut is tightened to draw the connector members together, the wave washer is compressed and the reaction force thereof urges the bayonet pins against the respective bayonet grooves and when the fully mated condition is reached the pins drop into detents or pockets in the respective grooves. This arrangement locks the coupling nut against unwanted rotation in the reverse direction.

Prior art connectors are also provided with other locking devices for the coupling nuts. U.S. Pat. No. 3,587,032, granted to Normann and assigned to the same assignee as this application, discloses a ball detent locking means for holding the coupling nut in its rotative position. In this patent, a coupling nut carries plural ball elements in the sleeve thereof in opposed relation to a toothed ring on the outside of the connector member which carries the coupling nut. A locking sleeve on the coupling nut has a cam element disposed adjacent the balls for camming the balls into engagement with the toothed ring to prevent retrograde movement when the nut is tightened. In U.S. Pat. No. 3,601,764 granted to Cameron, a connector is disclosed in which the coupling nut carries a detent finger in opposed relationship with a serrated ring on the connector member and a lock ring with cam means is provided to displace the finger into engagement with the serrated ring when the coupling nut is tightened. U.S. Pat. No. 2,946,035 granted to Tuchel discloses a connector having a coupling nut of the bayonet type and including a resilient wave washer which is compressed upon tightening of the nut for providing a reaction force to maintain the coupling nut in its advanced position.

A general object of this invention is to provide an improved locking means for electrical connectors which will overcome disadvantages of the prior art devices.

DISCLOSURE OF THE INVENTION

In accordance with this invention, a separable connector is provided with improved locking means for preventing unwanted rotation of the coupling nut after the nut is tightened. This comprises a resilient first detent element and a second detent element with one detent element on the coupling nut for movement therewith and being adapted to engage the other detent element when the nut is advanced to a predetermined position. The resilient detent element is deflected by engagement with the other detent element and interlocks therewith to prevent unwanted rotative motion of the coupling nut.

Further, according to the invention, the locking means of this invention may be incorporated into one connector member of the pair which comprises an electrical connector of standard construction so that the other connector member is of unaltered standard construction. This is accomplished in a connector with a bayonet coupling by disposing a resilient detent element on one of the connector members for engagement by the bayonet on the other connector member. Preferably the resilient detent element is disposed adjacent the forward wall of the bayonet groove so that the pin engages the detent as the nut is tightened and holds the nut in its rotative position. The resilient detent element preferably comprises an elongated leaf spring member with a series of peaks and valleys on one face with each peak extending into the path of the pin and being deflected thereby as the pin advances along the bayonet groove. The coupling nut is preferably provided with three separate bayonet grooves and the connector body has a set of three bayonet pins. Each of the grooves has the forward sidewall thereof interrupted at a predetermined location and a resilient detent is disposed at each location. In a preferred construction, the detent elements are formed in a ring member which is disposed in an annular groove at the forward end of the bayonet grooves.

A more complete understanding of this invention may be obtained from the detailed description that follows taken with the accompanying drawings.

BEST MODE FOR CARRYING OUT THE INVENTION

Figure 1:
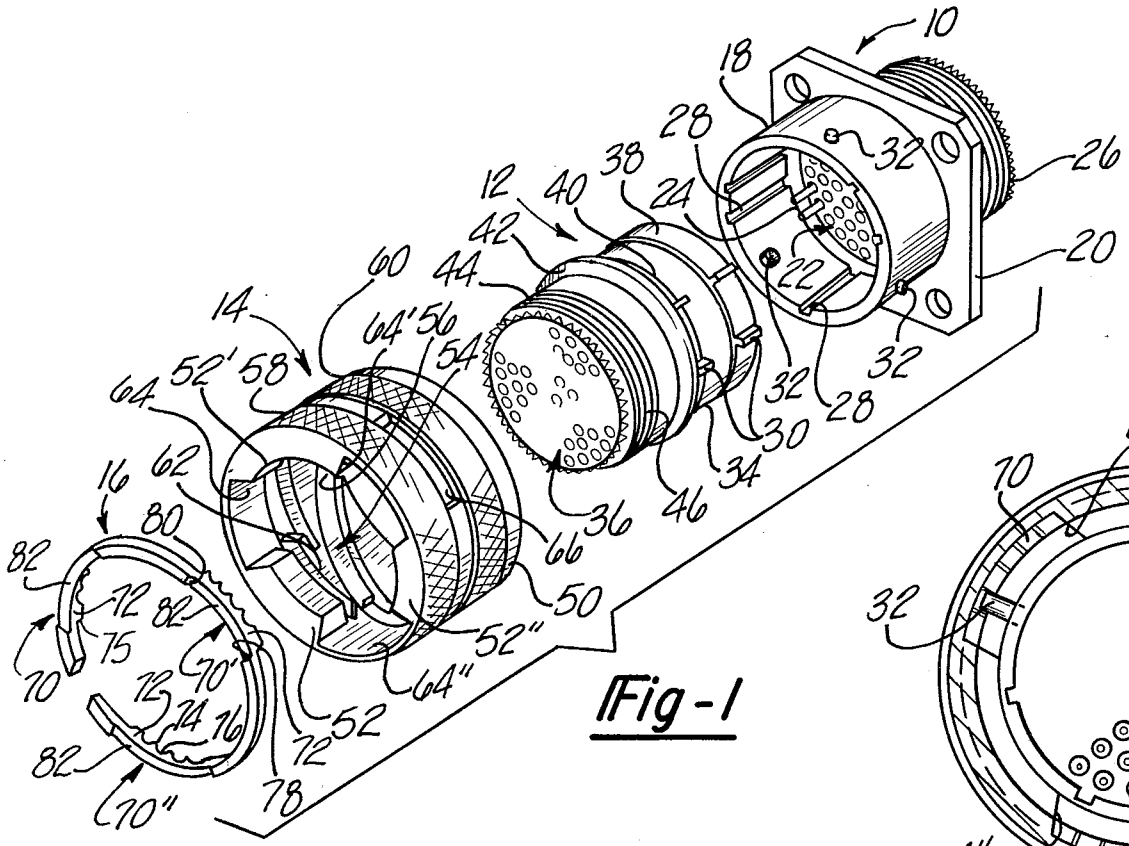
FIG. 1 is an exploded view of an electrical connector embodying the subject invention.
Figure 2:
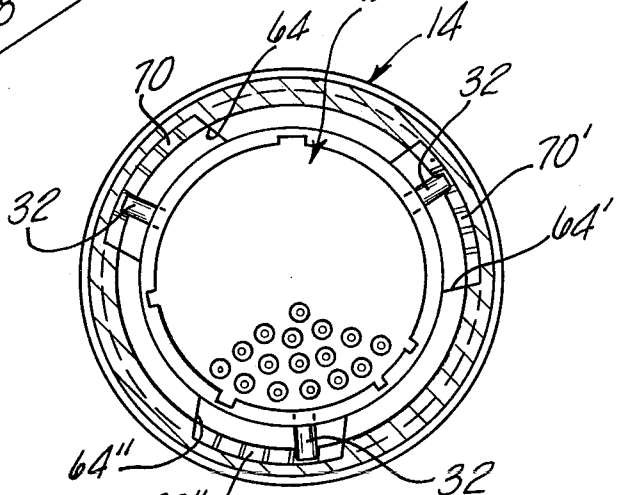
FIG. 2 is a cross sectional view of the connector taken on lines 2—2 of FIG. 3, and, FIG. 3 is an elevation view of the connector with parts broken away to show certain features of the invention.
Figure 3:
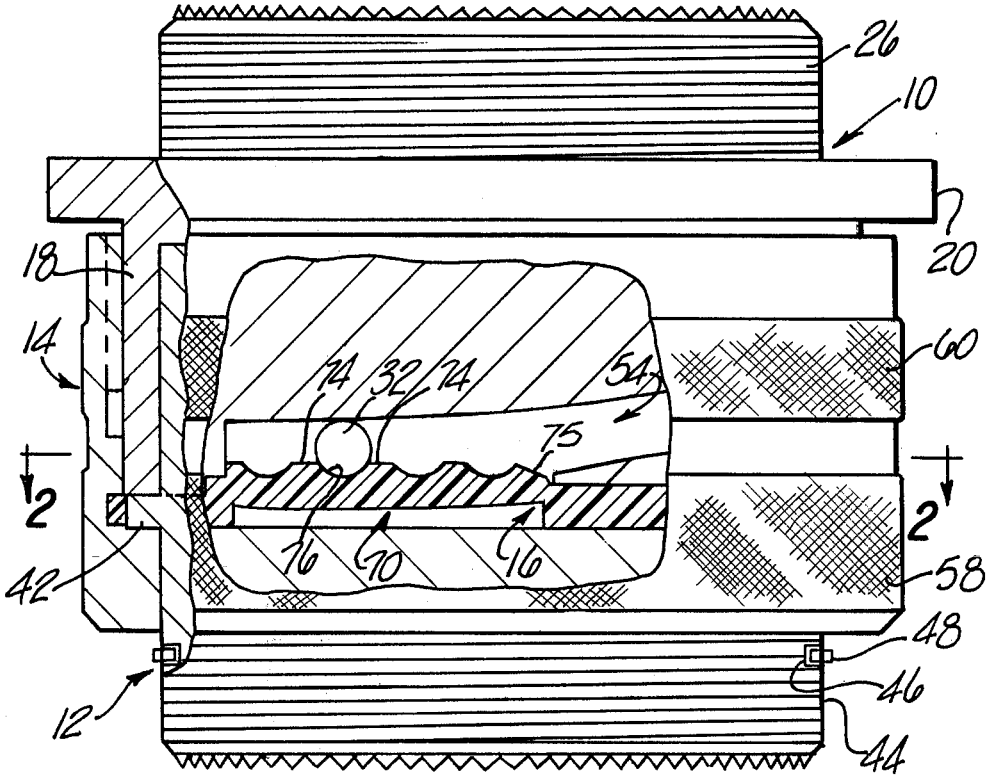

Referring now to the drawings, there is shown an illustrative embodiment of the invention in an electrical connector for connecting the wires of one cable to the corresponding wires of another cable. The connector is of the separable type adapted for quick connection using a coupling nut of the bayonet type for drawing the connector members together and releasably holding them in engagement. It will be appreciated, as the description proceeds, that the invention is also usable in other types of connectors having a coupling nut of either the bayonet coupling type or other thread coupling.

The connector comprises, in general, a receptacle 10 and a plug 12 which carries a coupling nut 14. The receptacle 10 receives the plug 12 in a predetermined orientation and the plug is drawn axially into abutting engagement with the receptacle by the coupling nut 14. The coupling nut and receptacle are coupled together by a bayonet coupling. The coupling nut 14 is provided with a locking ring 16 which is adapted to prevent unwanted reverse rotation of the coupling nut as will be described in detail subsequently.

The receptacle 10 comprises a connector member or body including a cylindrical shell 18 and a mounting flange 20 thereon. The cylindrical shell 18 is provided with an insert 22 which carries a plurality of contact pins 24 which are adapted to be connected individually at the rear of the insert to corresponding individual wires of a cable (not shown). The receptacle 10 also includes a threaded sleeve 26 which is rearward of the mounting flange 20 and adapted to receive a clamping nut (not shown) for retaining the electrical cable. The cylindrical shell 18 of the receptacle 10 is provided with internal keyways 28 which are adapted to receive corresponding keys 30 on the plug 12 to orient the plug relative to the receptacle. Additionally, the shell 18 of the receptacle is provided with three radially extending bayonet pins 32, suitably in the form of rivets. The pins 32 are circumferentially spaced equally and are disposed adjacent the forward end of the cylindrical shell 18.

The plug 12 comprises a cylindrical metal shell 34 which supports an insert 36 therein. The insert carries a plurality of socket contacts (not shown) at its forward end with the socket contacts corresponding in number and position to the pin contacts 24 in the receptacle. At the rearward end of the insert 36, the socket contacts are adapted to be connected separately to a plurality of corresponding wires of a cable (not shown). The cylindrical shell 34 has a forward rim 38 and a rearward rim 40 which have a clearance fit with the inside diameter of the shell 18 of the receptacle. The rims of the shell 34 carry the keys 30 which, as referred to above, mate with the keyways 28 on the shell 18 to orient the plug in the receptacle. The plug 12 also includes an annular flange 42 which is formed integrally with the metal shell 34 and which is adapted to be seated in abutting relationship on the end of the shell 18. The plug 12 is provided at its rearward end with a threaded sleeve 44 which is adapted to receive a clamping nut for the cable to be connected with the plug. The sleeve 44 is also provided with an annular groove 46 which is adapted to receive a snap ring 48 for retaining the coupling nut 14 on the plug 12, in a manner which will be described subsequently.

The coupling nut 14 comprises a cylindrical sleeve 50 which is provided at its rearward end with a segmented flange having three circumferential segments 52, 52' and 52". The flange segments are directed radially inwardly of the shell 50 and the shell is adapted to receive the plug 12 in telescoping relationship with the forward faces of the flange segments engaging the rearward face of the annular flange 42 on the plug. Thus, the coupling nut 14 is rotatably mounted on the plug 12 and is held against axial movement relative thereto in the forward direction. The coupling nut has been made with a segmented flange only for convenience of machining the illustrated embodiment; when the nut is made in production quantities the flange will not be segmented and the axial grooves 64, 64' and 64" (referred to below) will be eliminated. The coupling nut 14 is provided with a set of three internal threads in the form of bayonet or ramp grooves 54, each corresponding with one of the bayonet pins 32 on the receptacle 10. The three ramp grooves have equally spaced entrance ports 56 at the forward end of the sleeve 50 so as to be aligned with the respective pins 32. It is to be noted that when the coupling nut 14 is in threaded engagement with the receptacle 18 the pins 32 are tightened by clockwise rotation of the nut and the rearward sides of the pins 32 are in engagement with the forward walls of the grooves 54. When the coupling nut 14 is loosened by counterclockwise rotation thereof, the forward sides of the pins 32 are in engagement with the rearward walls of the grooves 54. The sleeve 50 of the coupling nut is provided with a pair of knurled rims 58 and 60 of enlarged diameter to facilitate the manual grasping of the coupling nut for rotation thereof.

The receptacle 10, plug 12 and coupling nut 14 (except for the segmented flange), as thus far described, are of known construction and are representative of a certain style of a standard electrical connector. According to this invention, the coupling nut 14 is provided with means to lock it in its forwardmost rotative position, as will be described in detail presently.

The coupling nut 14 is provided with an annular groove 62 in the inner wall of the sleeve 50 just forward of the annular flange segments 52, 52' and 52". Additionally, a set of three axially extending grooves 64, 64' and 64" are provided in the inner wall of the sleeve 50. The grooves 64, 64' and 64" extend axially from the rearward end of the sleeve 50 through the rear walls of the ramp grooves 54, respectively. The axial grooves 64, 64' and 64" have an outer diameter which is approximately the same as the root diameter of the ramp grooves 54. Actually, in the embodiment depicted in the drawings, the diameter of the axial grooves 64, 64' and 64" is somewhat larger than the root diameter of the ramp grooves 54 and consequently the wall of the sleeve 50 is cut away in the reduced diameter portion between the knurled rims 58 and 60 leaving three openings or windows 66. The coupling nut 14 has been made with the axial grooves 64, 64' and 64" only for convenience in mechining the illustrated embodiment and the windows 66 were provided thereby only to allow observation of the locking ring 16 during operation. When the nut is made in production quantities, the rear walls of the ramp grooves 54 will be removed at the location of the grooves 64, 64' and 64" between the annular groove 62 and the ramp grooves 54; however, a machining technique will be used which does not result in a segmented flange, as mentioned above, and which does provide the windows 66.

The locking ring 16 is adapted to be seated in the annular groove 62 in the coupling nut 14. The locking ring 16 comprises a split ring of resilient material, preferably a molded plastic, such as a polyamide-imide resin which is sold under the trademark "Torlon". The ring comprises three separate detent elements 70, 70' and 70'' which are formed at equally spaced locations around the circumference of the ring. Each detent element comprises a segment which constitutes a leaf spring 72 and which is yieldable in the axial direction. Each spring 72 is provided with a series of peaks 74 and valleys 76 extending in the axial direction. A ramp surface 75 is provided adjacent the first peak to facilitate entry of the pin 32 into the detent element. The locking ring 16 is inserted into the annular slot 62 with the detent elements 70, 70' and 70'' disposed in alignment with the axial slots 64, 64' and 64'', respectively. In this position, the detents 70, 70' and 70'' extend axially into the ramp grooves 54. Each detent element 70, 70' and 70'' terminates in respective shoulders 78 and 80 which extend axially into the ramp grooves and form an interlock with the walls of the ramp grooves so that the detent elements are held against circumferential displacement. Each of the leaf springs 72 has its rearward face 82 offset axially from the rearward face of the ring portions between the springs. The peaks 74 on the face of each of the springs 72 extend into the ramp grooves 54, respectively, and into the path of the pins 32. The leaf springs 72 are resiliently yieldable and are deflected by the respective pins 32 to allow the pins to pass by and be seated in one of the valleys 76 between the peaks.

In use of the connector of this invention, the plug 12 is inserted into the receptacle 10 with the keys 30 aligned with the respective keyways 28. The coupling nut 14 is positioned so that the ports 56 of the ramp grooves 54 are aligned with the respective pins 32. The coupling nut is then rotated in a clockwise direction and the interaction of the bayonet pins and grooves draws the plug and receptacle together. As the nut is tightened and the pins near the top or rearward end of the grooves 54 the pins will encounter the detent elements. It is noted that the rearward sides of the pins 32 are in engagement with the forward walls of the ramp grooves 54 and that the forward sides of the pins 32 engage the detent elements 70, 70' and 70''. In particular, the pins engage the peaks on the detent elements and the detent elements are deflected allowing the pins to pass over the peak. The rotation of the coupling nut is continued until an abutting engagement is produced between the annular flange 42 on the plug and the end of the sleeve 18 on the receptacle. At this position the rotation of the nut will stop and the bayonet pins 32 will settle into the adjacent valleys 76 of the detent elements. This will hold the coupling nut against unwanted rotation but will allow manual rotation of the nut in the reverse direction to separate the plug from the receptacle.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. In a separable connector of the type having first and second connector bodies adapted to be mated together, said second body being provided with a bayonet pin extending radially outward therefrom, a coupling nut rotatably mounted on the first body and provided with a groove arranged to be threadedly engaged by the pin for pulling the bodies together upon rotation of the nut in one direction and locking means operative between the coupling nut and the first body for restraining said nut against unwanted rotation in the other direction, the improvement wherein said locking means comprises:

a locking ring being carried on the nut for movement therewith and adapted to engage said pin, said groove having oppositely facing forward and rearward axial walls with the forward axial wall being adapted to engage the pin when the coupling nut is rotated in the one direction and the rearward axial wall being interrupted at a predetermined location to define a gap, said locking ring being disposed in said gap and including an elongated spring having a top axial surface in opposed relation to the forward axial wall of said groove, said top axial surface defining a successive series of peaks and valleys along the length of the spring, each peak extending into the path of said pin and being deflected thereby as said pin advances transversely thereacross and along said groove, each valley being adapted to trap said pin and hold the pin in each successive advanced position, whereby when the coupling nut is axially advanced to a predetermined position relative to the second body by rotation in the one direction said coupling nut is held against rotation and the first body is held in its advanced position relative to the second body.

2. The invention as defined in claim 1 wherein said coupling nut is provided with three of said grooves with each groove having an entrance port circumferentially spaced at the forward end of said coupling nut, said second connector body is provided with three of said pins with each of said pins being circumferentially spaced so as to be aligned with said entrance ports, each of said grooves being interrupted at a predetermined location to define a gap in the rearward axial wall of the respective groove and with an elongated spring being disposed in each of said gaps.

3. The invention as defined in claim 2 wherein said coupling nut is provided with an annular groove at the rearward end of said grooves, said locking ring being disposed in said annular groove.

4. The invention as defined in claim 1 wherein a ramp surface is provided adjacent the first peak to facilitate entry of the pin into the first valley.

5. A separable connector comprising:

a first connector body including a first cylindrical shell;

a coupling nut rotatably mounted and axially restrained on said first cylindrical shell, said coupling nut having a forward end and plural internal screw threads, each of said screw threads having an entrance port thereto spaced circumferentially around the forward end and providing at least one axially facing wall for engaging the pin, a second connector body including a second cylindrical shell having a plurality of pins extending radially outward therefrom, each pin being circumferentially spaced so as to be aligned with the entrance ports so that by engaging each pin with one respective screw thread, said first and second connector bodies may be secured together by rotating the coupling nut in one direction; and plural resilient elongated spring elements, each of said spring elements being disposed at a predetermined location relative to each of the plural screw threads and along the path of the respective pin, each of said spring elements being axially yieldable and having at least one axial surface in opposed relation to said one axial wall of the thread, said one surface defining an axially extending series of peaks and valleys along the length of the spring element, each peak extending into the path of said pin and being deflected thereby as the pin advances along the screw thread and transversely of the peaks and valleys, each valley being adapted to trap and hold the pin in the pins most advanced position such that rotating of the coupling nut continuously advances each of said pins along the respective thread in the axial direction until said first and second connector bodies are in abutting relation with each other and said pins are engaged within the farthest of said valleys whereby said coupling nut is held in its rotative position.

6. The invention as defined in claim 5 wherein said coupling nut is provided with an annular groove at the rearward end of said screw threads, a locking ring disposed in said groove, said spring elements are integrally formed in said ring.

* * * * *